United States Patent [19]

Smart et al.

[11] Patent Number: 4,804,317

[45] Date of Patent: Feb. 14, 1989

[54] ROTARY VANE PUMP WITH FLOATING ROTOR SIDE PLATES

[75] Inventors: Steven T. Smart; Charles D. McComas, both of Hutchinson, Kans.

[73] Assignee: Eaton Corporation, Cleveland, Ohio

[21] Appl. No.: 25,364

[22] Filed: Mar. 13, 1987

[51] Int. Cl.[4] ..... F04C 18/344; F04C 25/00; F04C 29/00

[52] U.S. Cl. ..... 418/110; 418/133; 418/152; 418/178; 418/179

[58] Field of Search ..... 418/133, 152, 178, 179, 418/256, 110, 131, 142, 253

[56] References Cited

U.S. PATENT DOCUMENTS

| | | | |
|---|---|---|---|
| 1,321,340 | 11/1919 | Stoke | 418/142 |
| 2,195,812 | 4/1940 | Czarnecki | 418/131 |
| 2,616,615 | 11/1952 | Scott | 418/152 |
| 3,433,166 | 3/1969 | Birkemeier | 418/152 |
| 3,552,895 | 1/1971 | Bayley | 418/178 |
| 3,640,648 | 2/1972 | Odawara | 418/133 |
| 3,695,789 | 10/1972 | Jansson | 418/133 |
| 4,198,195 | 4/1980 | Sakamaki et al. | 418/133 |
| 4,545,749 | 10/1985 | Sakamaki et al. | 418/179 |
| 4,615,663 | 10/1986 | Iio et al. | 418/152 |

*Primary Examiner*—John J. Vrablik

*Attorney, Agent, or Firm*—Edward L. Brown, Jr.

[57] ABSTRACT

A rotary vane pump having a metallic rotor, rotatably positioned within an ellipsoidal cavity, a pair of stationary wear plates on the sides of the cavity, the rotor having a plurality of radial slots each of which contain a carbon composite vane riding against the ellipsoidal cavity in reciprocal motion to define variable volume pumping chambers and a pair of carbon composite rotor side plates each being positioned between one side of the rotor and the stationary wear plates, each of the rotor side plates having a similar pattern of congruent radial slots to that of the rotor, the vanes having sufficient width to extend into the slots of both side plates to drive the side plates with the rotor during operating.

8 Claims, 2 Drawing Sheets

ROTARY VANE PUMP WITH FLOATING ROTOR SIDE PLATES

BACKGROUND OF THE INVENTION

In the general aviation field prior to the early 1960's, the vacuum systems which powered gyros were driven by pumps which were lubricated by oil and referred to in the art as wet pumps. In the 1960's, the oil lubricated, or wet vane vacuum pumps, were replaced by dry vacuum pumps constructed of carbon vanes and rotors which were self-lubricating.

To this present day, the standard dry vacuum pumps in the market comprise mechanical carbon rotors and vanes operating in a hardened metal ellipsoidal cavity. These pumps are very unreliable and they fail without indication in a very erratic pattern. Wear of the carbon parts sliding back and forth and their basic lack of structural strength have been major problems since they came on the market over 20 years ago. Powdered graphite and carbon with various organic binders which are compressed under high pressures and baked, produce a mass which has very little tensile strength.

One of the principal problems with carbon pumps has been the catastrophic failure of the rotor. The general concept of utilizing a metal rotor for strength with carbon end plates, is old in the art as taught by U.S. Pat. Nos. 4,570,316; 4,198,195; 3,282,222; 4,050,855 and 3,552,895. Some of these designs have attached the carbon end plates to the metal rotor by molding the parts together, as illustrated in the first two patents mentioned above.

Another method is to attach the carbon end plate to the pump body so the end plates are stationary, which is exemplified in the last three patents mentioned above.

SUMMARY OF THE INVENTION

The present invention also utilizes a metal rotor with carbon composite blades and carbon composite rotor side plates. The side plates of the present invention are not attached to the rotor but are driven by the vane ends which extend into the slots in the side plates to provide the necessary low friction bearing between the rotating rotor and stationary wear plates on the sides of the pump body. With the utilization of composite carbon and fiber, the respective vanes and side plates will no longer shatter which further diminishes the possibilities of catastrophic failure.

It is therefore the principal object of the present invention to provide a vacuum pump having a metal rotor with carbon composite side plates which are driven with the rotor by the ends of carbon composite vanes.

Another object of the present invention is to provide a dry vacuum pump utilizing composite vanes and side plates which are less receptive to catastrophic failure.

Another object of the present invention is to provide a dry vacuum pump which utilizes a rotor of non-ferrous metal while retaining the self-lubrication of carbon pumps.

A further object of the present invention is to provide a dry vacuum pump of increased life-span and with a relatively simple design.

Other objects and advantages of the invention will be apparent from the description of the preferred embodiments or may be learned by practice of the invention.

DETAILED DESCRIPTION OF THE INVENTION

Figure 1:
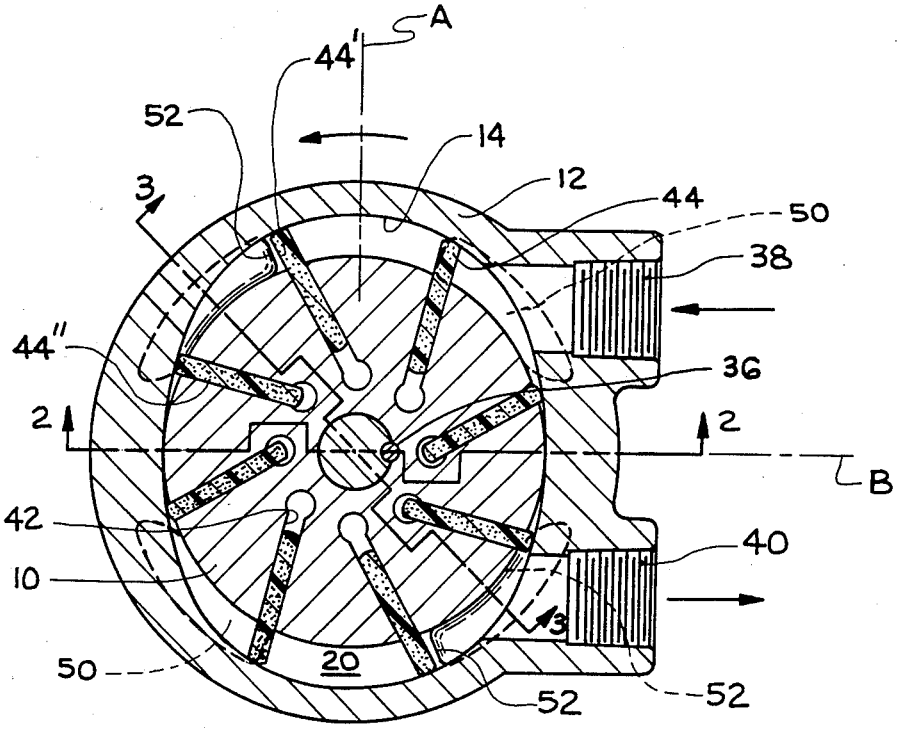
FIG. 1 is a transverse sectional view of the vacuum pump of the present invention.
Figure 2:
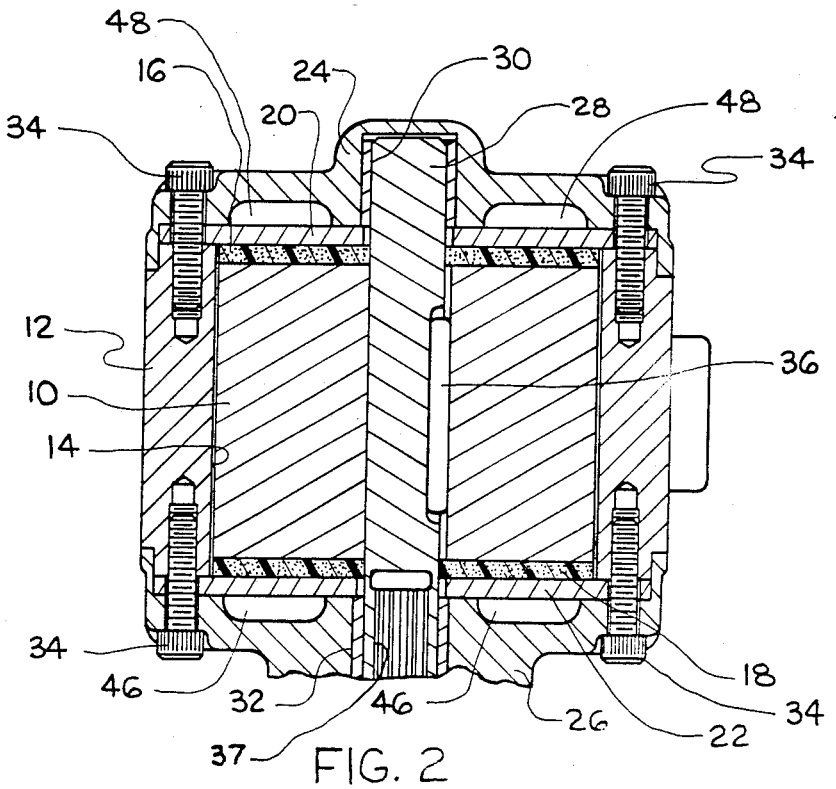
FIG. 2 is a longitudinal section of the pump taken along lines 2—2 of FIG. 1.

The dry vacuum pump of the present invention, as illustrated in FIGS. 1 and 2, comprises a rotor 10, rotatably mounted within a pump body 12 having inlet and outlet ports 38 and 40, respectively. Rotor 10 contains a plurality of radially extending slots 42 which are slightly offset from the center of the rotor 10. Positioned within the slots are a plurality of carbon composite sliding vanes 44 whose outer ends, by reason of centrifugal force, slide across the surface of ellipsoidal cavity 14 located within pump body 12. Rotor 10 is driven by drive shaft 28 through a key 36 and an inner-splined end 37. On the sides of the pump body 12 are a pair of end plates 24 and 26, as seen in FIG. 2, which position and retain wear plates 20 and 22. Sandwiched between stationary wear plate 20 and revolving rotor 10 is a rotor side plate 16 constructed of a carbon composite which has a plurality of radial slots 41 which are congruent with slots 42 and rotor 10, as can be best seen in FIG. 4. A similar side plate 18 is located on the opposite end of rotor 10. Both side plates have a substantially identical diameter to that of the rotor. While the side plates 16 and 18 are not attached to rotor 10, they are driven by the rotor through the ends of vanes 44 which extend into the respective slots 41 in each side plate 16 and 18. The carbon composite vanes 44 have essentially the same width as the combined width of the rotor and pair of side plates 16 and 18. The carbon composite side plates 16 and 18, as seen in FIG. 2, rotate against the stationary wear plates 20 and 22 which have a hardened wear surface on the inside surface. Wear plates 20 and 22 can be chrome-plated steel or a variety of other types of hardened surfaces while body 12 and rotor 10 are nonferrous metal such as aluminum.

Ellipsoidal cavity 14 likewise has a hardened surface to minimize the abrasion wear caused by the ends of composite blades 44. Cavity 14 can be either hard chrome-plated over aluminum, Cemkoted or hardened by some other process.

Vanes 44 and side plates 16 and 18 are formed of a carbon composite including tensile strength fibers combined with graphite and an organic binder. The fibers can be carbon cloth as well as various other heat resistant tensile strength fibers.

The graphite in the vanes and rotor plates provides sufficient lubrication against the stationary wear plates 20 and 22 and ellipsoidal cavity 14, so as not to require unreasonable drive forces on the pump or cause excessive vane or slot wear. The rotor plates which are unattached to the rotor 10 essentially float axially and position the rotating assembly in the body which includes the rotor 10, vanes 44 and rotor side plates 16 and 18.

Figure 4:
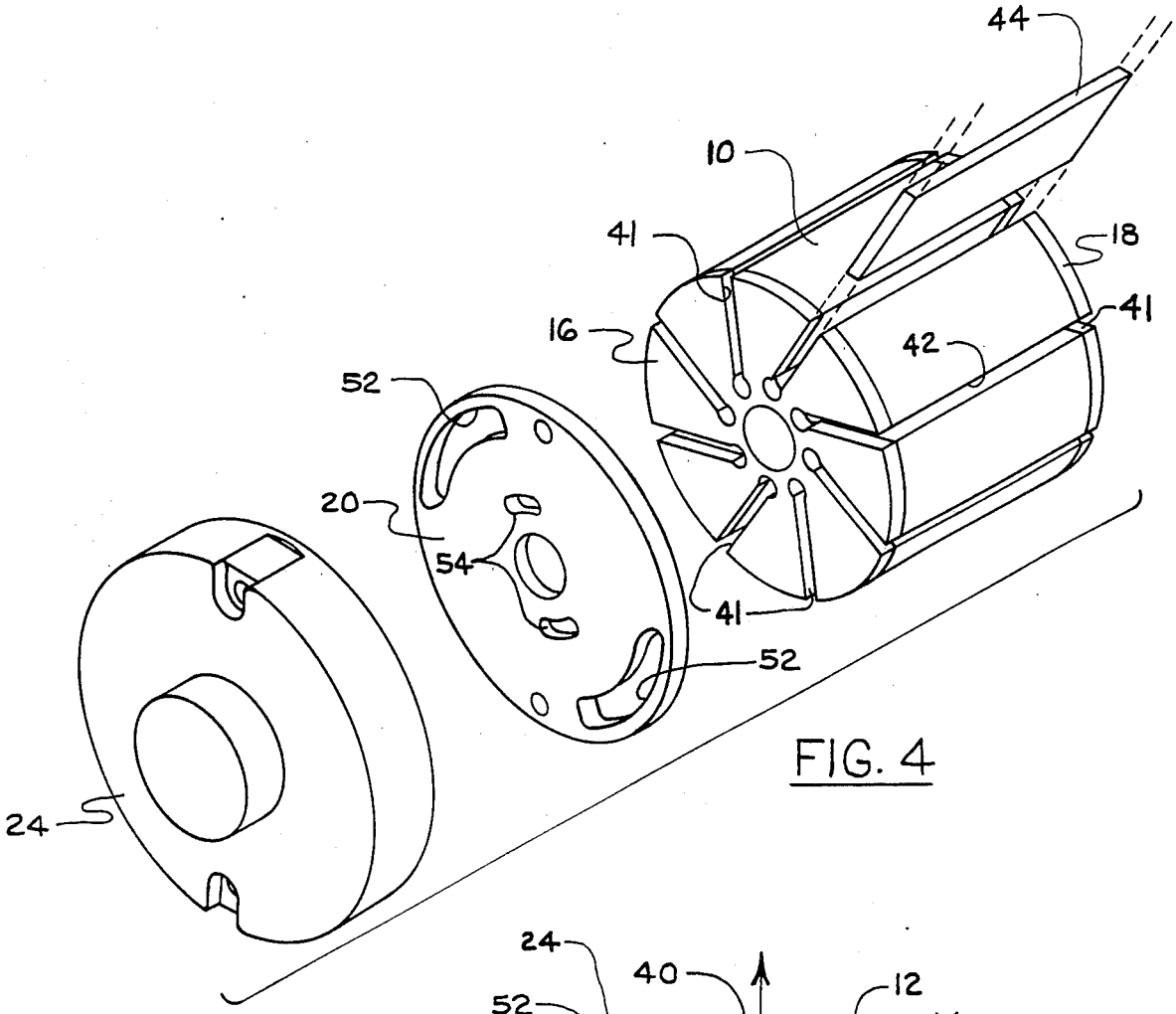
FIG. 4 is an exploded view of the rotating parts of the pump along with the wear plate and end plate on one side thereof.
Figure 3:
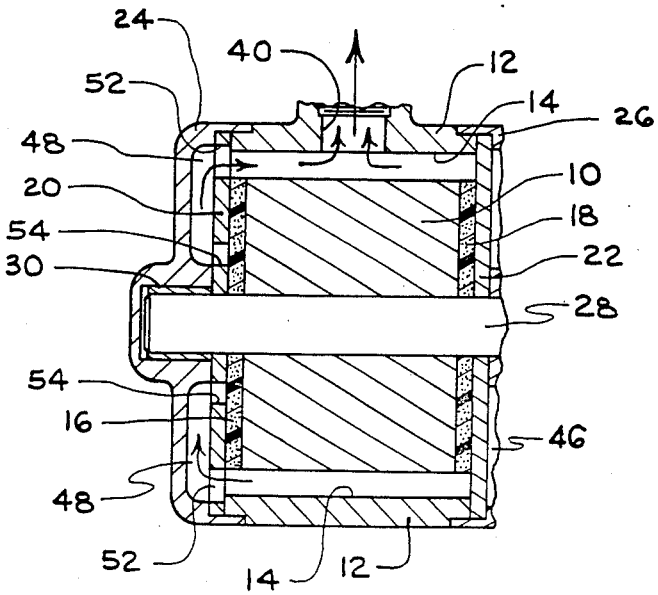
FIG. 3 is a longitudinal section taken along line 3—3 of FIG. 1.

Wear plate 20, as seen in FIGS. 1 and 4, includes a pair of discharge slots 52 which are connected together by an annular passage 48, as shown in FIG. 3, which in turn is connected to a discharge port 40 for discharging the air from the pump. Wear plate 22, positioned on the opposite side of rotor 10 has a similar pair of intake slots 50, as seen in FIG. 1. Each intake slot 50 is positioned 180° from the other and approximately 990° from the discharge slots 52 in the opposite wear plate 20. Intake slots 50 are connected by an annular passage 46, as seen in FIG. 2, which are in turn connected to intake port 38. Located in wear plate 20 are a second pair of small pressure balancing slots 54, as seen in FIGS. 3 and 4, which permit the pressure in rotor slots 42, under vanes 44, to equalize as the vanes slide back and forth in their respective slots. A similar pair of pressure balancing slots are located in the opposing wear plate 22, however, they are not shown in the drawings.

OPERATION

As the pump rotates in a counterclockwise direction, as viewed in FIG. 1, vane 44 slides outward in its slot 42 due to the action of centrifugal force as the vane tip rides in ellipsoidal cavity 14. A pump chamber is formed between two adjacent vanes which is expanding in volume until it reaches its maximum vane extension at major axis A, as seen in FIG. 1. As the vanes 44 and 44'' rotate 90° from axis A to axis B, they move from their fully extended position to their fully retracted position, which is a compression stroke of the rotor with gas being forced out through discharge slot 52. After passing through minor axis B, which is the horizontal axis through the pump, vanes 44 again begin to extend during the next 90° of rotation, thus forming a second intake stroke which draws air in through intake port 38 via annular passage 46 and intake slot 50. As vanes again pass through major axis A, at the bottom of the pump, they begin to retract for the next 90° which forms the second discharge stroke as the gases are ejected through slot 52 and discharge port 40.

As the pump rotates, the rotor plates 16 and 18 float between stationary wear plates 20 and 22 and rotating rotor 10. This floating action positions the rotating assembly of the pump which includes the rotor 10, vanes 44 and side plates 16 and 18 which are driven by the vane ends which extend into the slots 41 in the respective side plates. The rotating assembly just mentioned in turn rotates on drive shaft 28 which in turn rotates in fixed bearings 30 and 32 mounted in the respective end plates 24 and 26. Drive shaft 28 is driven by a spline shaft, not shown, through splined end 37, as seen in FIG. 2.

The clearance between vanes 44 and rotor slots 42 and 41 is maintained at a minimum such as 0.005 inches or less to prolong pump life and reduce vane dishing and reaction forces on the various components of the pump. The overall concept of floating rotor side plates would also have an application in oil pumps wherein the side plates and vanes were bronze or steel-backed bronze rather than carbon.

Other applications of this driven side plate vane pump may be considered by those skilled in the art upon reviewing the description of this preferred embodiment.

Having described the invention with sufficient clarity to enable those familiar with the art to construct and use it, we claim:

1. A rotary vane pump comprising:

a body having an ellipsoidal cavity with intake and discharge ports therein;

a pair of stationary wear plates mounted on the sides of said cavity;

a metallic rotor member rotatably mounted and positioned within the cavity having a plurality of radial slots, a plurality of carbon composite vanes positioned in said slots which are urged outwardly by centrifugal force into engagement with said cavity to define variable volume pumping chambers for drawing fluids into the pump through the intake port and discharging them through the discharge port;

floating rotor side plates made of a carbon composite positioned on opposite sides of the rotor between the two wear plates in sliding relation therewith, the side plates having a congruent pattern of radial slots with those in the rotor, the vanes having sufficient width to extend into the slots of both side plates to drive the side plates with the rotor.

2. A rotary vane pump as set forth in claim 1 wherein the vane width extends from one stationary wear plate to the other.

3. A rotary vane pump as set forth in claim 1 wherein the vane width extends from one stationary wear plate to the other and the rotor side plates are connected to the rotor through the vane ends which engage the slots in the rotor side plates.

4. A rotary vane pump as set forth in claim 1 wherein the vanes and rotor side plates are constructed of a carbon composite including high strength fibers and the ellipsoidal cavity in the body has a hardened surface.

5. A rotary vane pump as set forth in claim 1 wherein the stationary wear plates and the ellipsoidal cavity have a hardened surface, and the vanes and rotor side plates are constructed of a carbon composite including high strength carbon fibers.

6. A rotary vane pump as set forth in claim 1 wherein the rotor side plates are substantially identical in diameter to the rotor with a conventional tolerance fit between the rotor, side plates and wear plates within the ellipsoidal cavity.

7. A rotary vane pump as set forth in claim 1 wherein the body and rotor are constructed of aluminum and the ellipsoidal cavity has a hardened surface.

8. A rotary vane pump as set forth in claim 1 wherein the body and rotor are constructed of aluminum and the tolerance fit of the vanes in the rotor slots is less than 0.005 inches.

* * * * *